United States Patent [19]

Aicher et al.

[11] Patent Number: 4,877,463

[45] Date of Patent: Oct. 31, 1989

[54] METHOD FOR PRODUCING ROLLED STEEL PRODUCTS, PARTICULARLY THREADED STEEL TENSION MEMBERS

[75] Inventors: Max Aicher, Freilassing; Dieter Jungwirth, Munich; Hans-Wilhelm Klein, Mitterfelden; Dieter Russwurm, Puchheim, all of Fed. Rep. of Germany

[73] Assignee: Dyckerhoff & Widmann Aktiengesellschaft, Munich, Fed. Rep. of Germany

[21] Appl. No.: 205,556

[22] Filed: Jun. 7, 1988

Related U.S. Application Data

[63] Continuation of Ser. No. 86,215, Aug. 13, 1987, abandoned, which is a continuation of Ser. No. 769,156, Aug. 23, 1985, abandoned.

[30] Foreign Application Priority Data

Aug. 23, 1984 [DE] Fed. Rep. of Germany ..... 3431008

[51] Int. Cl.[4] ..... C21D 9/52

[52] U.S. Cl. ..... 148/12 B

[58] Field of Search ..... 148/12 B, 12.4, 39, 148/12.1, 902, 907

[56] References Cited

U.S. PATENT DOCUMENTS

| | | | |
|---|---|---|---|
| 4,016,009 | 4/1977 | Economopoulos | 148/12 B |
| 4,175,985 | 11/1979 | Blundelot et al. | 148/12 B |
| 4,180,418 | 12/1974 | Paulitsch et al. | 148/12 B |
| 4,204,892 | 5/1980 | Economopoulos | 148/39 |
| 4,295,902 | 10/1981 | Economopoulos | 148/39 |
| 4,298,406 | 11/1981 | Brownlee et al. | 148/39 |

FOREIGN PATENT DOCUMENTS

| | | | |
|---|---|---|---|
| 137729 | 9/1979 | Fed. Rep. of Germany | 148/12 B |
| 2916218 | 10/1980 | Fed. Rep. of Germany | 148/12 B |
| 2238768 | 3/1975 | France | 148/12 B |

OTHER PUBLICATIONS

Economopoulos et al., "Steel Furnace Monthly", Application of the Tempcore Process to . . . Concrete-Reinforcing Bars, Feb. 1977, pp. 57–73.

Simon et al., Iron and Steel Engineer, "Tempcore: A new Process for . . . Reinforcing Bars", Mar. 1984, pp. 53–57.

Vlad et al., American Society for Metals, Metals/-Material Technology Series, "Microstructures and Mechanical Properties . . . ", 1983, 8306–47, pp. 1–13.

*Primary Examiner*—John J. Zimmerman

*Attorney, Agent, or Firm*—Toren, McGeady & Associates

[57] ABSTRACT

To produce threaded steel tension members, steel is used with a C-content of 0.50 to 0.80%, preferably 0.75%, a Si-content of 0.20 to 0.50%, preferably 0.25%, and a Mn content of 0.30 to 0.80%, preferably 0.60%. Exiting from the rolling heat at the outlet side of the finishing stand after hot rolling, the tension member or rod is subjected to surface quenching by a cooling medium, preferably water, so that the steel in a rim zone $R_1$ is transformed immediately and completely into martensite, while the heat content remaining in the core zone $K_1$ does not effect a tempering of the martensite rim zone during the subsequent cooling beyond the range of the intermediate stage. Steel tension members of this type have a high ductility and toughness at a high yield limit and high strength, they are corrosion-resistant to a great degree and have a wear resistant surface which makes them particularly suitable for threaded tension rods in which the threads are produced either by a cold forming operation or hot rolled ribs.

5 Claims, 2 Drawing Sheets

METHOD FOR PRODUCING ROLLED STEEL PRODUCTS, PARTICULARLY THREADED STEEL TENSION MEMBERS

This is a continuation of application Ser. No. 086,215 filed Aug. 13, 1987 abandoned which in turn is a continuation of Ser. No. 769,156 filed Aug. 23, 1985 abandoned.

The invention is directed to a method of producing rolled steel members, particularly steel threaded tension members or rods.

Steel tension members such as rods used in building and heavy construction as tension members for prestressed concrete, but also as steel anchor member for soil and rock anchors, as form work anchors, as suspension cables for suspension bridges, as diagonal cables for stayed girder bridges, and as braces or stays, generally have a tensile yield point varying from 835 to 1080 $N/mm^2$ and a tensile strength in the range of 1030 to 1230 $N/mm^2$. In the conventional methods used exclusively up to the present time, steel containing a C-content of 0.65 to 0.75%, a Si-content of 0.60 to 1.60% and an Mn-content of 0.70 to 1.508, as well as chrome and/or vanadium and other alloying elements, have been used as the base material.

Steel tension members of this type are known in various construction operations, such as, round wires which are cold drawn after rolling strength and subsequently are tempered again, or flat steel members, for example, steel which undergoes a temper-hardening across the entire cross-section after rolling, or steel rods. Steel rods with diameters between approximately 15 and 50 mm are hot rolled, then stretched in order to increase the yield point and subsequently tempered for stress relief. Aside from the fact that only limited lengths can be produced because of the stretching operation, this costly production method brings about high costs.

Aside from the static strength values, steel tension members must also have the highest possible elastic limit and a good deformability. In threaded tension steels, that is, those on which threaded anchors can be attached, a high wear resistance of the surface and also corrosion resistance are important. The relaxation characteristic, as well as a sufficiently high fatigue strength are also important.

In addition to steel tension members for prestressed concrete structural parts, steel reinforcing bars are used as untensioned or non-pretensioned reinforcing for steel-reinforced concrete reinforcing rods of this type are either used with natural hardness, wherein the strength is determined by means of the alloying, or are cold formed, for example, by means of drawing or cold rolling, the latter being employed especially for steel reinforcing mats. Steel reinforcing members of this type must be weldable, accordingly, their analysis or make-up is distinguished by a low C-content. As a rule, such reinforcing members have a yield point between 420 and 500 $N/mm^2$ and a tensile strength between 500 and 550 $N/mm^2$. Steel reinforcing members with higher strength values are generally not produced. The steel make-up content used deals exclusively with those steels, suitable for welding, having a C content of less than 0.22%.

Steel reinforcing bars or rods are produced with a smooth surface and as ribbed reinforcing members. Ribbed reinforcing rods usually have sickle-shaped ribs extending diagonally relatively to the long axis of the rod, and these ribs extend in the transverse direction over a large part of the circumferential surfaces of the rod and are intended to improve the bonding action of the reinforcing rod in the concrete.

To increase the strength and improve the deformability of hot rolled steel reinforcing bars or rods of this type, it is known to subject the rods exiting out of the rolling heat at the outlet side of the finishing stand to a surface quenching by means of a cooling medium so that there is a rim zone of martensite or bainite in the rod cross-section immediately after quenching, while the heat content remaining in the rod core does not cause a tempering of the rim zone beyond the bainite stage during the subsequent cooling (DE-AS 23 53 034). This known method is based on the concept of increasing the strength and improving the deformability without increasing the carbon or manganese content which runs contrary to the requirement for a good welding ability. A typical analysis or make-up content of a reinforcing steel heat-treated in this manner is 0.17 to 0.22% C, 0.05 to 0.30% Si, as well as 0.70 to 1.10% Mn.

SUMMARY OF THE INVENTION

With this prior art serving as background, the invention has the object of providing an accurate and economical production method for steel tension members, particularly for threaded steel tension members with the strength characteristics named in the beginning, which permits the use of the steel constituent make-up, which is easily and economically reproducible metallurgically, for forming steel tension members which are corrosion-resistant, have a wear-resistant surface for reducing the danger of mechanical damage and can be suitably threaded. In addition, steel tension members can be produced in desired rod lengths with a greater ductility and toughness and a higher tensile yield point and higher strength, particularly at low temperatures, and with a high fatigue strength and a reduced relaxation effect.

This object is met, according to the invention, in using steel with a C-content of 0.50 to 0.80%, preferably approximately 0.75%, a Si-content of 0.20 to 0.50%, preferably approximately 0.25%, and a Mn-content of 0.30 to 0.80%, preferably approximately 0.60%. The steel exits from the rolling heat at the outlet side of the finishing stand of a hot rolling mill and is subjected to a surface quenching by means of a cooling medium, preferably water, so that the material in a rim zone of the steel cross section is transformed immediately and completely into martensite, while the heat content remaining in the core zone does not effect a tempering of the martensite rim zone during subsequent cooling beyond the range of the intermediate stage.

The final rolling temperature at the finishing stand is advisably selected in such a way that it lies just under the transformation point A at the lower limit of the hot deformability of the steel. The final rolling temperature is advisedly between 860° and 1060° C., preferably between 880 ° and 940° C.

According to the invention, the tempering is effected in such a way that the surface temperature of the rim zone is no more than approximately 500° C., preferably between 400° and 500° C., in the time period between the second and sixth seconds of the heat treatment in dependence on the rod diameter.

The invention is based on the discovery that the cooperation of a combination of determined factors is required in order to produce a steel capable of use as tension members with the indicated characteristics in an economical manner.

Of particular importance is that the steel has a relatively high C content producing a high strength which is increased even further by means of the subsequent heat treatment. While the austenitization taking place during the temper-hardening as a special homogenization treatment, the latter is performed by the heating in the rolling mill furnace, as well as by the rolling process itself, during the production of steel tension members according to the invention. The degree of homogeneity of the constituents making up the steel, the size of the austenite grain and the temperature of the solution heat treatment are decisive for the product.

The size of the austenite grain is determined, among other factors, by the recrystallization which occurs during the hot rolling after each pass. In absolute terms, the grain size is smaller the more frequently and intensively the steel member is deformed. However, the final grain size achieved appears only in the last rolling pass; the deformation and the temperature, as well as the dwell time at this temperature of the cooling process, are decisive here until the start In the production of steel tension members according to the invention, there must be, before the cooling commences, a very fine-grained structure which forms at least in the area of the strong deformation in the rim zone of the steel rod being rolled. The risk of the formation of very resistant austenite grains, which unfavorably influence the corrosion resistance of the steel, is accordingly reduced.

It is particularly advantageous if the temperature at the last rolling pass, that is at the finishing stand, lies at the lower limit of the hot forming property or hot deformability, that is, just under the transformation point $A_3$. A very fine grained structure results and recrystallization is prevented to a great degree. In connection with this, a cooling must take place rapidly and intensively so that the cooling curve of the rim zone reaches the martensite range without reaching the range of the ferrite, pearlite, and the intermediate stage. This is particularly important in a relatively high-carbon steel in which the martensite starting temperature $M_S$ is relatively low. However, a core zone within the rod must, at the same time, have a sufficient heat content to bring about a tempering of the martensite present in the rim zone.

The conditions under which this process takes place can be explained with the aid of FIG. 1 showing a time temperature transformation curve for a steel which approximately has the preferred constituent content for the invention, that is, 0.76% C, 0.23% Si, and 0.63% Mn.

The curve $R_1$ shows the curve of the surface temperature of a steel rod with relatively small diameter, for example, 15.1 mm and the curve $K_1$ shows the curve of the temperature of the core zone for the same rod. R2 is the corresponding curve of the surface temperature for a rod with a greater diameter.

Significant for the heat treatment is the course of the curve $R_1$ in the tempering range. To achieve the grain structure satisfying the demands for a steel tension member, the curve $R_1$ of the surface temperature must be within the temperature range between 400° and 500° C. in the time interval between the second and the sixth second of the heat treatment shown in FIG. 1; under no circumstances may it reach the pearlite range.

The heat transfer from the core zone is also accelerated by the strong cooling of the rim zone. In accordance with the steel constituent composition, transformation is effected directly in the intermediate stage area or prior to the formation of pearlite. This is viewed as particularly advantageous if the core zone of the rod transforms in the upper intermediate stage area which is distinguished by a fine dispersion of the carbides.

The intensity of the cooling in the rim zone depends substantially upon the cooling output of the available installation. The cooling output is dependent upon a plurality of the factors. For a known cooling installation a water quantity of 10 to 20 l/sec kg is viewed as particularly advantageous. A transformation inertia supporting this process can also be achieved by means of the constituent composition of the steel. Thus, for example, not only the increase of the carbon content, but also of the rest of the alloying elements of the steel such as Mn, Si, Cr, Ni, Mo, act in this manner.

By adding additional alloying elements certain characteristics of the steel tension members are successfully improved. Thus, the addition of chrome (up to approximately 0.8%) and copper (up to approximately 0.5%) cause an increase of the corrosion resistance, the addition of vanadium (up to approximately 0.15%) and niobium (up to approximately 0.06%), as well as traces of the micro-alloying elements titanium and boron, cause an increase of the toughness and fatigue strength. The C content can also be successfully lowered to the lower limit by a corresponding selection of the alloying elements.

As tests have shown, the steel tension members produced according to the invention meet the demands imposed on them to a high degree. Compiled in Table 1, see end of the specification, are the constituent compositions of some melts of the steel types 835/1030 (ratio: yield limit/tensile strength) and 885/1080 for steel rods with diameters of 26.5 mm and 15.1 mm, respectively. Table 2 provides the static strength values calculated as mean values of some steel rods produced, according to the invention, with diameters 36.0 mm, 26.5 mm and 15.1 mm. Re designates the yield limit, Rm designates the tensile strength, $A_{10}$ designates the rupture elongation over a measured length corresponding to ten times the diameter of the rod, and $A_G$ designates the elongation before a reduction in area.

The high corrosion resistance of the steel produced according to the invention is chiefly the result of great uniformity of structure, the low temperature during rolling, and the rapid cooling preventing disturbance factors from developing. Moreover, relaxation tests for determining the inelastic extension or elongation at 1000 hours show that the relaxation losses are very low. Bending tests show excellent ductility characteristics of the specimens examined.

Since the steel tension members produced according to the invention have a very fine grain structure in the rim zone and a correspondingly high surface strength, they are particularly suitable for the production of threaded steel tension members.

To transfer the tension forces to a structural part, threaded anchors are often used on tension rods. In this context, it is known to roll threads onto the ends of the rods rolled with smooth surfaces in cold forming operation. In contrast to a cut thread, such a thread formation has the advantage that a strengthening of the steel structure, particularly in the region of the thread grooves, is achieved with reduced core cross-section so that the steel rod can also be utilized in the threaded region with the full force corresponding to its cross-section while taking into account the allowable tension. It is also known to construct the thread so that the rounded portion of the thread grooves has a substantially greater radius of curvature than the rounded portion at the outer tips of the thread teeth or ribs (DE-PS 10 68 454). A thread with such rounded grooves allows considerably greater tolerances relative to the thread of the nut and accordingly provides the conditions for the ability to absorb or adjust to tolerances during the installation of the anchor member without damage.

In addition, it is known to provide a tension rod by hot rolling, with helically extending ribs arranged on two opposite sides of the circumferential surface of the rod forming parts of a thread on which an anchor member provided with a corresponding counter-thread (DE-PS 17 84 630) can be placed. The partial thread achieved in this manner has very coarse tolerances relative to a metric thread so that it effectively meets the demands of heavy duty construction practices. Moreover, the thread is present along the entire length of the rod without any additional expenditure.

Finally, it is also known to form the ribs produced by hot rolling as transverse ribs which extend approximately along tension rod half the circumference of the cylindrically shaped and which decrease in width and height toward their ends (DE-PS 20 43 274). Only portions of these ribs lie on a helical line which, however, provides the possibility that anchor members with right-hand as well as left-hand threads can be screwed onto such a partial thread.

Accordingly, the subject matter of the invention is still the application of the method to the production of hot rolled steel rods or wires with smooth surfaces which are provided, at least at the end, with threads formed by cold rolling and suitable for screwing on a connecting or anchoring member, having threads with the rounded portion of the thread grooves having a substantially greater radius of curvature than at the thread tips; as well as to the production of steel rods or wires provided with ribs by hot rolling, with such ribs extending at least partially along a helical line, arranged at two opposite sides of the circumferential surface of the rod and forming parts a thread on which a connecting or anchoring member provided with a corresponding counter thread can be applied.

It is important, particularly in steel rods with hot rolled ribs that the quenching action is not impaired due to the surface shape of the rods and that the surface profiling of the rods is selected in such a way that the rods have a uniform heat-treated layer in the region of the ribs.

It has been shown that when the height, the average width, and spacing of the ribs, are in a determined ratio relative to one another, with the ribs acting as cooling ribs during the heart treatment of the rod, the heat removal in the region of the ribs is comparatively greater than in the area of the smooth rod surface so that the boundary zone between the core zone and the rim zone of the rod extends linearly. This ratio is advisably 0.5 to 1 to 4.

The various features of novelty which characterize the invention are pointed out with particularity in the claims annexed to and forming a part of this disclosure, For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
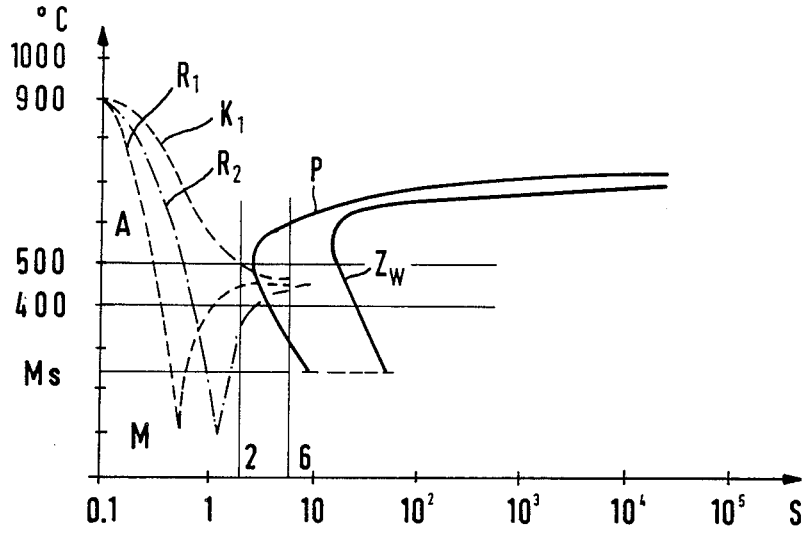
FIG. 1 is a graph illustrating a time-temperature transformation curve for a steel tension member produced according to the present invention.
Figure 2:
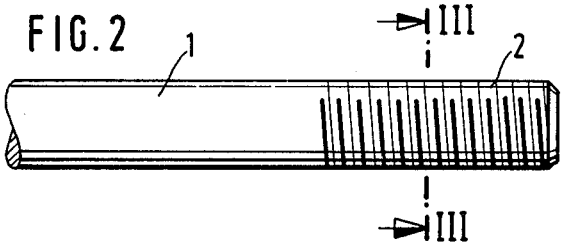
FIG. 2 is a partial side view of a tension rod with a smooth surface and a thread rolled on one end of the rod.
Figure 3:
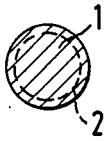
FIG. 3 is a cross-sectional view along line III—III in FIG. 2.
Figure 4:
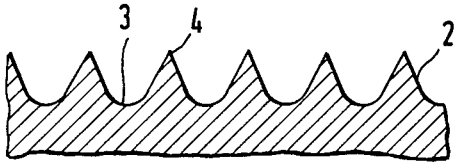
FIG. 4 is a partial axially extending sectional view of the thread displayed on an enlarged scale.

Steel rod 1, shown in FIG. 2, rolled as a smooth rod, was subjected to the heat treatment according to the invention. A thread has been rolled on the rod end in a cold forming operation and the thread 2 is indicated in FIG. 4, in an axially extending section on a greatly enlarged scale. The thread is a so-called asymmetric partial thread, that is, the radius of the rounded portion in the region of the thread grooves 3 is substantially greater than the radius of the tip 4 of the thread tooth or rib.

Figure 5:
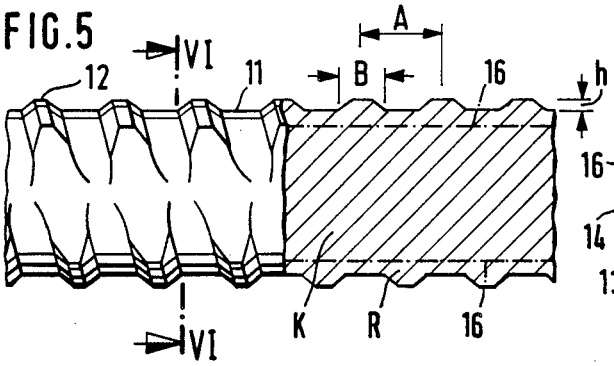
FIG. 5 is a partial side view of a tension rod with hot rolled thread ribs extending along a helical line.
Figure 6:
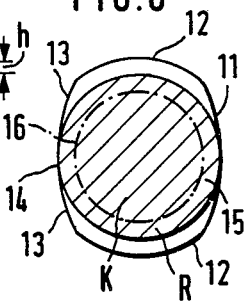
FIG. 6 is a cross-sectional view along the line VI—VI in FIG. 5 in normal projection.

The steel tension rod 11 set forth in FIGS. 5 and 6 is a so-called threaded rod provided with thread ribs 12 in a hot rolling procedure. The ribs 12 have a height h, an average width B and are spaced apart from one another at a distance A with the ratio of h:B:A being approximately 0.5 to 1 to 4. The ribs 12, in each instance extend approximately over a third of the circumference of the rod in full height with the transition from the full height into the circumferential surface 14 of the rod core 15 being at the rib ends 13.

In FIGS. 5 and 6, it is indicated that the boundary zone 16 between the rim zone R, where the material of the steel rod has been transformed into martensite by surface quenching, and the core zone K, where heat content remaining after surface quenching causes the subsequent tempering of the martensite rim zone R, to extend approximately linearly. This is the result of the enhanced cooling effect of the ribs during surface quenching and has the advantage of a continuously high surface strength of the steel and a very favorable corrosion resistance.

Figure 7:
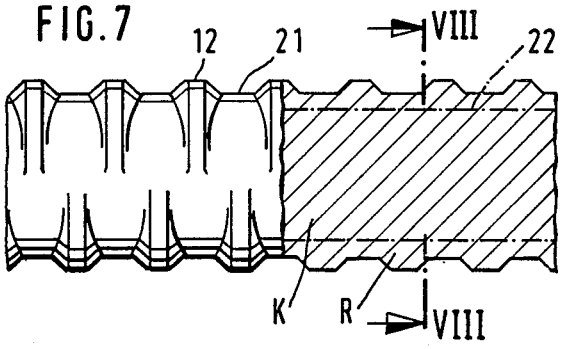
FIG. 7 is a partial side view of a tension rod with hot rolled, transversely extending thread ribs.
Figure 8:
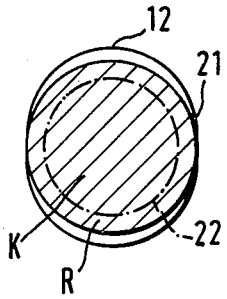
FIG. 8 is a cross-section taken along line VIII—VIII in FIG. 7 in normal projection.

Similar ratios also prevail in the threaded rod 21, shown in FIGS. 7 and 8, where the ribs 12 are formed as transverse ribs. In this embodiment, the boundary zone extends linearly between the core zone K and the rim zone R of the rod without being influenced by the ribs.

Due to the high surface strength of the heat-treated rim zone R, comprising the hot rolled ribs, it is possible to construct the anchoring and connecting members, such as nuts, sleeves or the like, shorter than in known tension rods with a homogeneous rod cross-section. With shorter anchoring and connecting members, however, the force transmission in the threaded region between the rod and nut or sleeve will be improved.

While specific embodiments of the invention have been shown and described in detail to illustrate the application of the inventive principles, it will be understood that the invention may be embodied otherwise without departing from such principles.

TABLE 1

| Melt No. | steel Grade | Diameter mm | (Constituent Composition Values) C | Si | Mn | (Mass %) P | S |
|---|---|---|---|---|---|---|---|
| 3726 | 835/1030 | 26.5 | 0.74 | 0.28 | 0.45 | 0.017 | 0.025 |
| 3728 | 835/1030 | 26.5 | 0.76 | 0.30 | 0.44 | 0.024 | 0.031 |
| 3742 | 885/1080 | 15.1 | 0.73 | 0.23 | 0.35 | 0.027 | 0.031 |
| 3572 | 885/1080 | 15.1 | 0.75 | 0.21 | 0.34 | 0.018 | 0.039 |

TABLE 2

| Melt No. | Steel Grade | diameter mm | elasticity limit N/mm² | elasticity [Young's] module N/mm² | Re N/mm² | Rm N/mm² | $A_{10}$ % | $A_G$ % | Notched tensile values Re N/mm² | Rm N/mm² | $A_G$ % |
|---|---|---|---|---|---|---|---|---|---|---|---|
| 3608 | 835/1030 | 36.0 | | | 861 | 1196 | 7.2 | | | | |
| 3610 | 835/1030 | 36.0 | | | 849 | 1201 | 7.5 | | | | |
| 3726 | 835/1030 | 26.5 | 882 | 210000 | 1002 | 1251 | 9.7 | 5.0 | 987 | 1213 | 2.9 |
| 3728 | 835/1030 | 26.5 | 848 | 209000 | 942 | 1212 | 10.2 | 5.9 | 968 | 1210 | 4.0 |
| 3572 | 885/1080 | 15.1 | 923 | 205000 | 927 | 1179 | 10.8 | 7.1 | 927 | 1170 | 4.0 |
| 4192 | 885/1080 | 15.1 | 889 | 210000 | 929 | 1153 | 11.0 | 6.6 | 903 | 1098 | 3.6 |
| 5216 | 1080/1230 | 15.1 | | | 1158 | 1287 | 7.4 | 4.2 | | | |
| 5226 | 1080/1230 | 15.1 | | | 1203 | 1298 | 7.7 | 5.3 | | | |

We claim:

1. A method of producing an axially extending rolled steel member for use as prestressing steel member and having a generally circular transverse section with an axially extending core zone (K) enclosed by an axially extending annular rim zone (R) and comprising the steps of forming the steel member with a C content in the range of 0.50 to 0.80%, a Si content in the range of 0.20 to 0.50%, a Mn content in the range of 0.30 to 0.80%, hot rolling the steel member in a rolling mill with a finishing stand having an outlet, removing the rolled member from the outlet of the finishing stand at the final rolling temperature and selecting the final rolling temperature in the range of 860° to 1060° C., surface quenching in a single operation the rolled member at the rolling temperature from the finishing stand using a cooling medium so that the rim zone (R) is transformed immediately into martensite while maintaining the heat content in the core zone (K) so that the heat content does not temper the martensite rim zone during subsequent cooling beyond the range of the intermediate stage, and surface quenching and tempering the steel member so that the surface temperature of the rim zone, depending on the diameter of the steel product, is in the range of 400° and 500° C. in the time interval between the second and sixth second following the commencement of surface quenching.

2. A method, as set forth in claim 1 wherein forming the steel product with a C content of approximately 0.75%, a Si content of approximately 0.25%, and a Mn content of approximately 0.60%.

3. A method, as set forth in claim 1, wherein selecting the final rolling temperature at the finishing stand so that the temperature is at the lower limit of heat deformability of the steel just below the transformation point $A_3$.

4. A method, as set forth in claim 1, wherein selecting the final rolling temperature in the range of 880° C. and 940° C.

5. A method, as set forth in claims 1, 2 or 5, wherein including in the constituent composition of the steel product at least one of the following: up to approximately 0.8% chrome, up to approximately 0.5% copper, up to approximately 0.15% vanadium, up to approximately 0.06% of niobium, and traces of titanium and boron.

* * * * *